United States Patent [19]

Redel

[11] 4,125,286

[45] Nov. 14, 1978

[54] CONVERTIBLE CHAIR

[76] Inventor: Ray H. Redel, 756 Gateview Ave., Albany, Calif. 94706

[21] Appl. No.: 159,411

[22] Filed: Jul. 2, 1971

[51] Int. Cl.[2] ..... A47C 3/20

[52] U.S. Cl. ..... 297/325; 297/345; 297/26

[58] Field of Search ..... 297/56, 345, 26, 25, 297/24, 19, 21, 325; 108/116, 118; 248/421

[56] References Cited

U.S. PATENT DOCUMENTS

| | | | |
|---|---|---|---|
| 102,022 | 4/1870 | McAleer | 297/56 |
| 612,792 | 10/1898 | Thompson | 297/345 X |
| 730,306 | 6/1903 | Smith | 297/345 |
| 775,388 | 11/1904 | Thompson | 297/345 X |
| 1,434,777 | 11/1922 | Handler | 297/19 |
| 2,624,469 | 1/1953 | Cadwell | 108/116 X |
| 3,100,125 | 8/1963 | Crescent | 297/26 |
| 3,157,430 | 11/1964 | Hamilton | 297/19 |
| 3,495,873 | 2/1970 | Hamilton | 248/421 |

FOREIGN PATENT DOCUMENTS

| | | | |
|---|---|---|---|
| 1,245,756 | 10/1960 | France | 297/26 |

*Primary Examiner*—Francis K. Zugel

[57] ABSTRACT

A convertible chair involving a pair of X-frames, each providing a front and rear leg, and a seat pivotally secured directly at its front edge to the upper ends of the rear legs, and at its rear end to a pair of links, each in turn being pivotally secured to the upper end of one front leg, whereby the chair may be adjusted from a position for dining, in which the seat is substantially horizontal and the back substantially vertical, to a lower position with the seat and back tilted for lounging.

5 Claims, 7 Drawing Figures

CONVERTIBLE CHAIR

My invention relates to furniture in general and more particularly to a convertible chair.

Normally small apartments, even with separate dining areas, are limited as to the amount of furniture that can be made available to accommodate guests, and this usually means that dining chairs, which are uniformly uncomfortable for relaxing, are usually relied on for after dinner use, when entertaining guests.

Among the objects of my invention are;

(1) To provide a novel and improved chair;

(2) To provide a novel and improved chair which can be converted from a vertical upright position, suitable for dining, to a lower reclining position suitable for lounging;

(3) To provide a novel and improved chair which can be converted from a vertical upright position suitable for dining, to a lower reclining position suitable for lounging, and which has both lateral and vertical stability in either position.

Additional objects of my invention will be brought out in the following description, with reference to the accompanying drawings, wherein FIG. 1 is a front view in elevation, of a convertible chair incorporating the features of the present invention;

FIG. 4 are comparative views, depicting the high and low adjustments of the chair of the preceding figures;

Figures 1, 2:
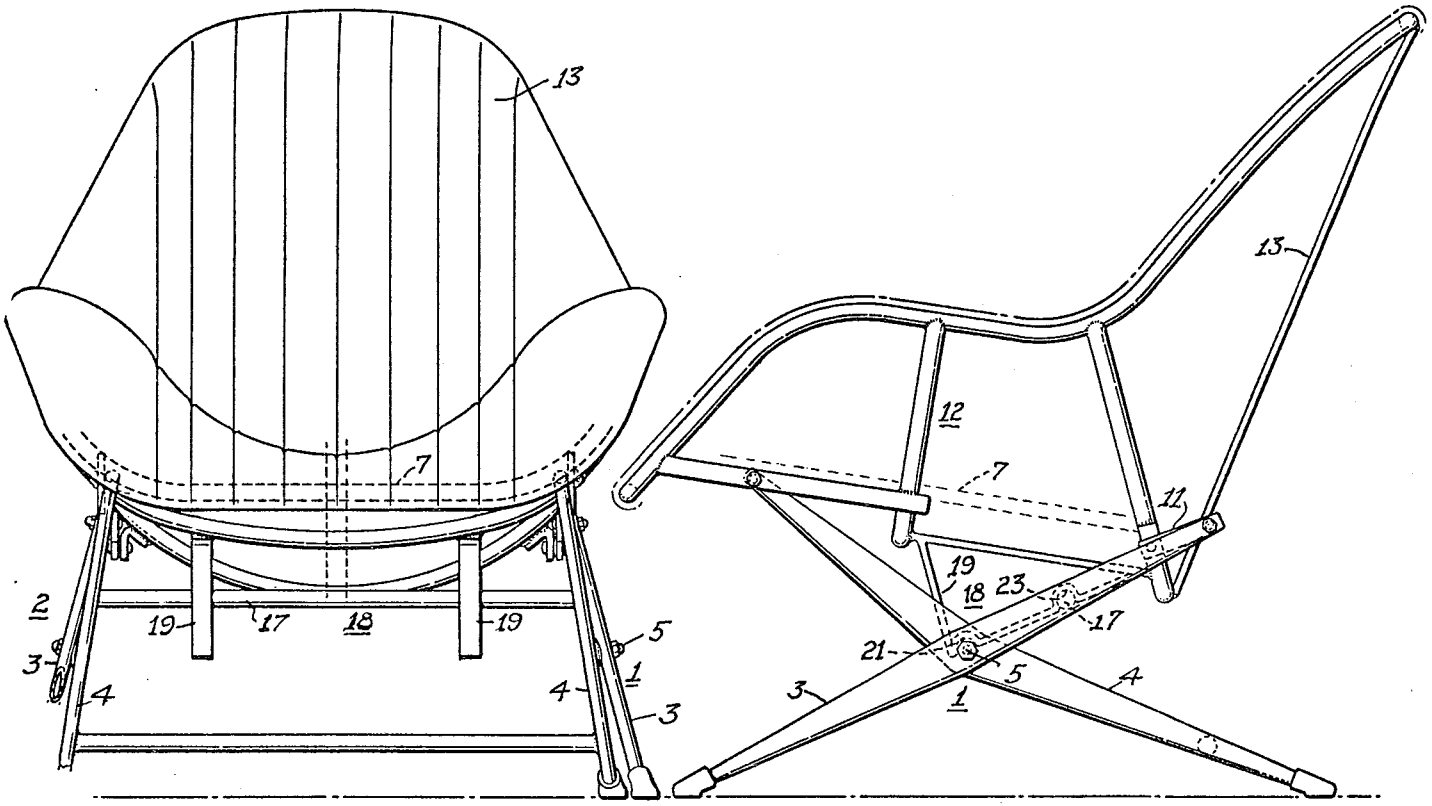
FIG. 2 is a side view in elevation, of said chair with the covering removed to disclose structural features of the invention.
Figure 3:
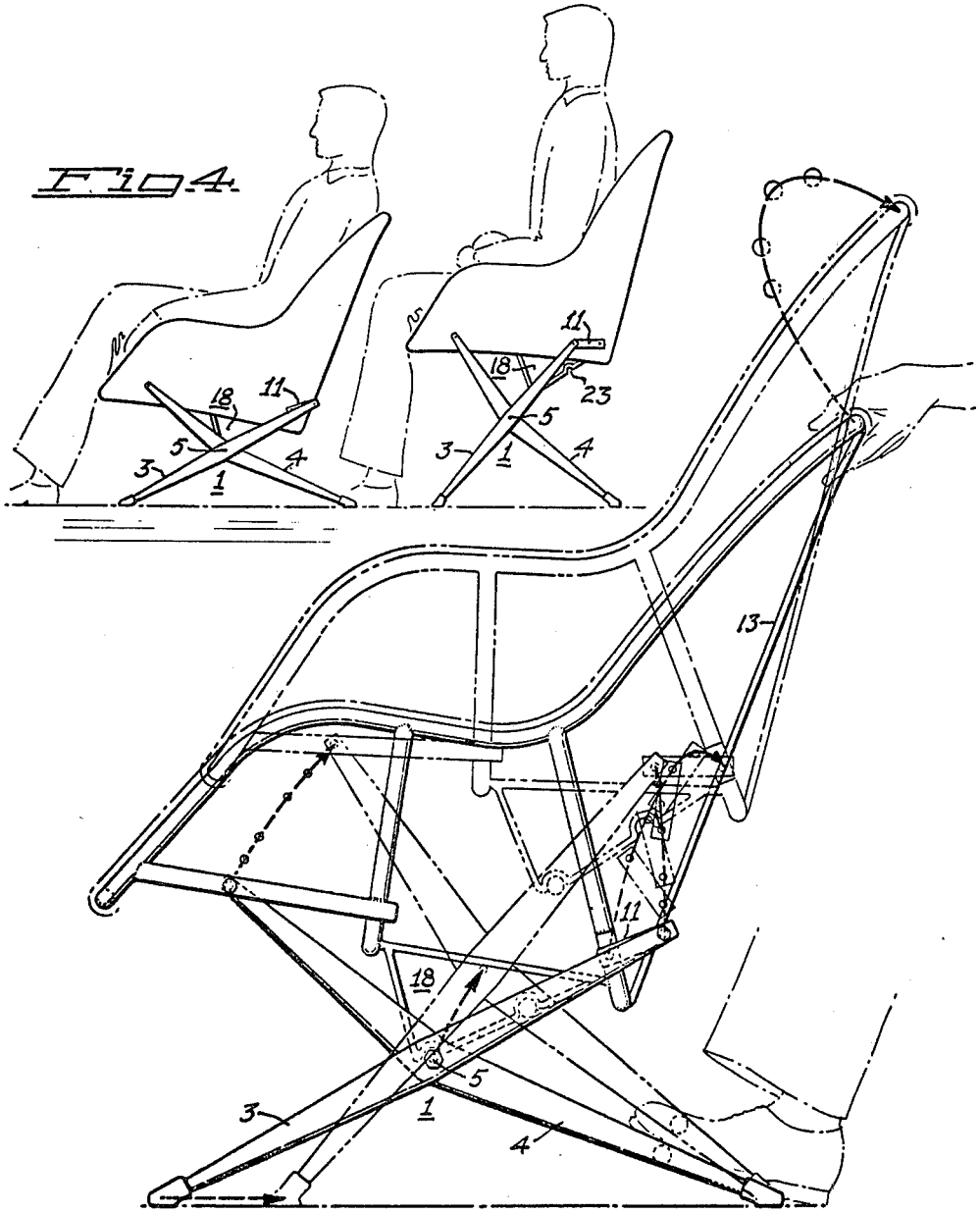
FIG. 3 is a side view in elevation, depicting the mode of adjustment to obtain convertibility.

Referring to the drawings for details of the invention in its preferred form, the same comprises a pair of X-frames 1 and 2, each comprising a pair of legs 3 and 4 pivotally joined at a common intermediate pivot point 5, and in combination with the companion X-frame, supporting a seat 7. The rear leg 4 of each X-frame, from the pivot point to the floor or supporting surface, is constructed longer than the corresponding portion of the front leg.

Said seat is pivotally supported adjacent its front edge to the upper part of the corresponding rear legs of each pair of X-frames 1, 3. The rear edge of the seat, on the other hand, is pivotally supported by a pair of links 11, which are connected to the upper ends of the remaining corresponding legs of the X-frames.

The rear edge of said seat may accordingly be rotated on an axis joining corresponding ends of said links, which axis, itself, is angularly movable about the axis through the other ends of said links.

The rear edge of said seat in this embodiment is connected via framework 12, to a backrest 13, whereby both the backrest 13 and the seat 7 move as a unit.

Interconnecting the front legs of the X-frames, is a cross bar 17, located beyond and above the pivot axis of the X-frames.

A cross bar engaging and stabilizing means 18 is supported from beneath the seat frame in position to differently engage said cross bar 17, in accordance with the prevailing position of the seat.

In the preferred embodiment under consideration, the engaging and stabilizing means may take the form of a pair of spaced apart triangular shaped brackets 19, each having deep resilient notches 21 and 23 or equivalent clips in that side facing said cross bar. The spacing between the notches or clips is a factor in establishing the high and low adjustments of the chair.

With the chair so constructed, as described above, the upright position is determined when the forward notch or clip 21 engages the cross bar 17. In this position, it is noted, that the seat 7 is relatively high and essentially horizontal, and with the backrest 13 approaching the vertical, such characteristics being identified with chairs suitable for dining purposes.

By lifting the seat sufficiently to break the prevailing engagement between the notch 21 and cross bar 17, the seat may be lowered to the point of bringing the notch or clip 23 into gripping engagement with the cross bar, thus determining the lower adjustment of the chair.

It is important to note in this connection that as the chair is lowered, both the seat 7 and back rest 13 rotate to a reclining position, attributable largely to the increased length of the rear legs. This, in conjunction with the lower elevation of the seat 7, identify those characteristics associated with a chair suitable for lounging.

Without the cross bar engaging and stabilizing means, the chair could still assume a high and low position of adjustment, but under these conditions, the weight of the occupant would have to be borne by the existing pivots, which, as a general rule, are not load bearing members and would have to be made exceedingly rugged for the purpose.

Figures 5, 6, 7:
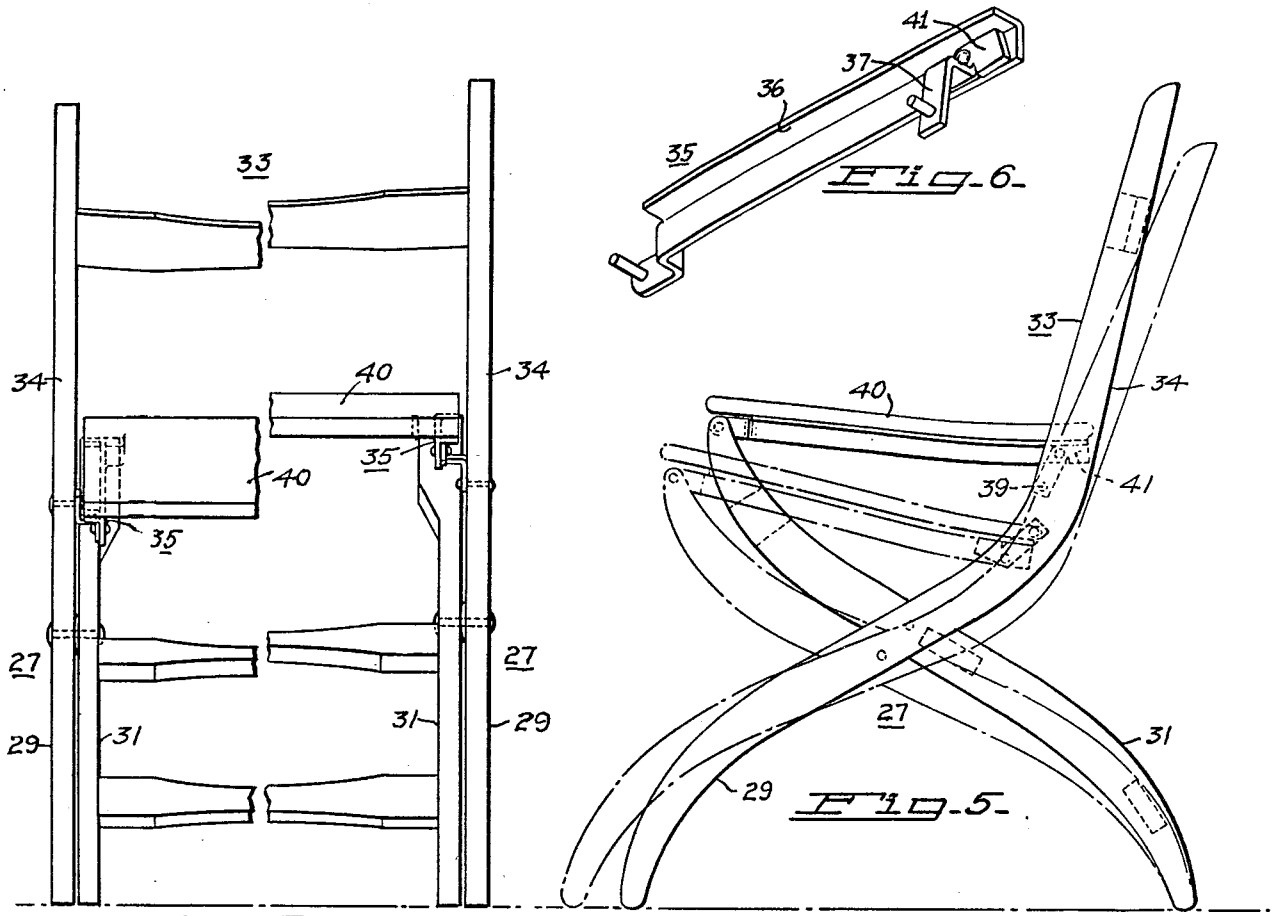
FIG. 5 is a side view in elevation, of a modification of the invention of FIG. 1.
FIG. 6 is a three dimensional view of a seat bracket involved in the chair of FIG. 5.
FIG. 7 is a view depicting the two positional adjustments of the chair of FIG. 5.

A modification of the invention is shown in FIGS. 5, 6 and 7.

This embodiment involves a pair of X-frames 27, each providing a front leg 29 and a rear leg 31 pivotally connected as in the preceding embodiment. In this embodiment, however, the back rest 33, is formed by upward extensions 34, of the front legs.

A pair of seat support brackets 35 (FIG. 6) each including a flange 36, are pivotally connected at their front ends, to the proximate upper ends of the rear legs.

The rear of each seat support bracket on the other hand, is pivotally connected to a link 37, the other end of which link is similarly secured to a point 39 on the upper rear portion of the proximate front leg. Brackets 35 carry seat 40.

One end of each of said links is constructed with a lateral extension or stop 41, such that rotation is limited, as when the lateral extension abuts against said flange.

With the chair constructed as described above, the upright position is defined when the terminal position of each link, as determined by the lateral extension or stop 41 associated therewith, is such that the end connected to the seat bracket is higher in elevation and to the rear of that end of the link which is connected to the upper end of the proximate front leg of the chair. In this position the seat is essentially horizontal and the back rest approaches the vertical.

By gripping the back of this chair in one hand and tilting the chair forward on its front legs, the seat may be grasped by the other hand and rotated about the pivot 39 from the high solid line position of FIG. 5 to the lower broken line position. This action ultimately causes the legs of the chair to spread with a consequent additional lowering of this pivot point 39 until the stop again abuts the proximate seat bracket flange. This additional lowering of the pivot 39 brings the seat to a reclining position as shown. Simultaneously with the lowering of the seat, the same spreading of the legs brings about a rearward tilting of the back rest 33. The resulting adjustment thereby imparts to the chair, those characteristics suitable for lounging.

It should be noted that both embodiments have the same function, namely, to be readily adjustable into either a dining or reclining position. Also, in each case, when adjusting to the reclining position, a lowering and tilting of the seat is accompanied by a rearward tilt of the back rest.

It will be apparent, therefore, that the invention as described, fulfills all the objects attributed thereto, and while I have illustrated and described two embodiments of the same, it will be apparent that the invention is subject to alterations and modifications without departing from the underlying principles involved, and I, accordingly, do not desire to be limited to the specific details illustrated and described except as may be necessitated by the appended claims.

I claim:

1. A chair convertible from an upright type having a seat and a backrest, to a reclining type in which the seat is at a greater angle to the horizontal and the backrest is at a greater angle to the vertical, in each instance with respect to said chair in its upright position, said chair comprising a pair of X-frames each providing a front leg and a rear leg pivotally connected together at an intermediate point in each, with said rear leg from said pivot point to its lower end being longer than the corresponding portion of said front leg, whereby a spreading of said legs will cause said seat to tilt to a greater angle with respect to the horizontal, and said backrest to a greater angle with respect to the vertical, means for converting said chair from an upright position to a reclining position and vica-versa, and means for stabilizing said chair in each of said positions, said stabilising means including a cross bar interconnecting said front legs of the X-frames, and cross bar engaging means supported below said seat in position to differently engage said cross bar in accordance with the prevailing position of said seat.

2. A convertible chair in accordance with claim 1, characterized by said cross bar engaging means including a pair of resilient notches or clips adapted to engage said cross bar in accordance with the prevailing position of said seat.

3. A chair convertible from an upright type having a seat and a backrest, to a reclining type in which the seat is at a greater angle to the horizontal and the backrest is at a greater angle to the vertical, in each instance with respect to said chair in its upright position, said chair comprising a pair of X-frames each providing a front leg and a rear leg pivotally connected together at an intermediate point in each, with said rear leg from said pivot point to its lower end being longer than the corresponding portion of said front leg, whereby a spreading of said legs will cause said seat to tilt to a greater angle with respect to the horizontal, and said brackrest to a greater angle with respect to the vertical, means for converting said chair from an upright position to a reclining position and vica-versa, and means for stabilizing said chair in each of said positions, said seat and said backrest being integral.

4. A chair convertible from an upright type having a seat and a backrest, to a reclining type in which the seat is at a greater angle to the horizontal and the backrest is at a greater angle to the vertical, in each instance with respect to said chair in its upright position, said chair comprising a pair of X-frames each providing a front leg and a rear leg pivotally connected together at an intermediate point in each, with said rear leg from said pivot point to its lower end being longer than the corresponding portion of said front leg, whereby a spreading of said legs will cause said seat to tilt to a greater angle with respect to the horizontal, and said bracket to a greater angle with respect to the vertical, means for converting said chair from an upright position to a reclining position and vica-versa, said means for converting said chair from an upright position to a reclining position and vica-versa, including a link coupled at one end to the rear upper end of one front leg, and with its other end coupled to said seat in proximity to its rear edge, and a similar link likewise coupled between the rear upper end of the other front leg and said seat, and means for stabilizing said chair in each of said positions.

5. A convertible chair in accordance with claim 4, characterized by said seat and said backrest being integral.

* * * * *